US009926690B2

(12) United States Patent
Peteri

(10) Patent No.: US 9,926,690 B2
(45) Date of Patent: Mar. 27, 2018

(54) DISPENSING ARRANGEMENT FOR WATER

(71) Applicant: Henri Peteri Beheer B.V., Ridderkerk (NL)

(72) Inventor: Niels Theodoor Peteri, Rotterdam (NL)

(73) Assignee: HENRI PETERI BEHEER B.V., Ridderkerk (NL)

( * ) Notice: Subject to any disclaimer, the term of this patent is extended or adjusted under 35 U.S.C. 154(b) by 0 days.

(21) Appl. No.: 14/396,308

(22) PCT Filed: Apr. 24, 2013

(86) PCT No.: PCT/EP2013/058502
§ 371 (c)(1),
(2) Date: Oct. 22, 2014

(87) PCT Pub. No.: WO2013/160353
PCT Pub. Date: Oct. 31, 2013

(65) Prior Publication Data

US 2015/0121616 A1 May 7, 2015

(30) Foreign Application Priority Data

Apr. 24, 2012 (NL) ..... 2008698

(51) Int. Cl.
*E03C 1/04* (2006.01)

(52) U.S. Cl.
CPC ..... *E03C 1/0412* (2013.01); *E03C 1/0411* (2013.01)

(58) Field of Classification Search
CPC ..... E03C 1/0411; E03C 1/0412; E03C 1/055; E03C 1/041; E03C 1/044
See application file for complete search history.

(56) References Cited

U.S. PATENT DOCUMENTS 4,549,716 A * 10/1985 Warren ..... F16K 31/60 192/69.91
4,911,335 A * 3/1990 Stofle ..... E03C 1/102 137/216

(Continued)

FOREIGN PATENT DOCUMENTS

CN 1411570 4/2003
CN 1578891 2/2005

(Continued)

OTHER PUBLICATIONS

State Intellectual Property Office of the People's Republic of China, Notification of the First Office Action for corresponding Chinese Application No. 201380021643.8, dated Aug. 24, 2015.

(Continued)

*Primary Examiner* — Janie Loeppke
(74) *Attorney, Agent, or Firm* — Steven M. Koehler; Westman, Champlin & Koehler P.A.

(57) ABSTRACT

A dispensing arrangement for water comprises a tap, in particular a kitchen tap such as a boiling water tap, provided with a shut-off valve and an operating element, such that the dispensing arrangement is operable with a compound movement of the operating element. For dispensing of the water at least a portion of the compound movement serves to release the shut-off valve prior to operation and comprises at least one of a movement to-and-fro, a repeated movement and a movement of at least a predetermined duration and wherein a subsequent portion of the compound movement serves to operate the shut-off valve.

20 Claims, 4 Drawing Sheets

(56) References Cited

U.S. PATENT DOCUMENTS

| | | | | |
|---|---|---|---|---|
| 5,417,348 | A | 5/1995 | Perrin et al. | |
| 7,025,077 | B2 * | 4/2006 | Vogel | F24D 17/00 126/362.1 |
| 2007/0246550 | A1 | 10/2007 | Rodenbeck | |
| 2009/0113619 | A1 * | 5/2009 | Tichenor | E03C 1/08 4/650 |
| 2012/0227841 | A1 | 9/2012 | Peteri | |

FOREIGN PATENT DOCUMENTS

| | | | |
|---|---|---|---|
| CN | 201567622 | | 9/2010 |
| DE | 202008009127 | U1 | 11/2008 |
| DE | 102008006255 | A1 | 8/2009 |
| EP | 0204881 | | 12/1986 |
| NL | 2000746 | C2 | 1/2009 |
| NL | 2003127 | A | 12/2010 |
| WO | 2004059197 | | 7/2004 |
| WO | 2011036181 | A1 | 3/2011 |

OTHER PUBLICATIONS

Office Action and English translation for corresponding TW Patent Application No. 102114440, dated Jul. 19, 2016, 30 pages.

Third Office Action for Chinese patent application No. 201380021643.8, dated Dec. 1, 2016.

International Search Report and Written Opinion dated Jul. 29, 2013 for corresponding International Application No. PCT/EP2013/058502, filed Apr. 24, 2013.

* cited by examiner

DISPENSING ARRANGEMENT FOR WATER

CROSS-REFERENCE TO RELATED APPLICATION

The present application is a national stage filing of International patent application Ser. No. PCT/EP2013/058502, filed Apr. 24, 2013, and published as WO 2013/160353 in English.

TECHNICAL FIELD

The discussion below is merely provided for general background information and is not intended to be used as an aid in determining the scope of the claimed subject matter. Aspects of the present invention relate to a dispensing arrangement for water comprising a tap, in particular a kitchen tap such as a boiling water tap.

BACKGROUND

A plurality of sorts and models of water taps is known. Examples are singular taps that are arranged for closing a single supply line and mixing taps that are arranged for opening/closing different supply lines to a common outlet. In addition, taps are known for chilled and/or filtered water. Further, taps for (almost) boiling water have made their appearance. Due to this diversity that has risen it appeared that an unclarity may exist for users about the temperature (to be expected) of the dispensed water. This unclarity with respect to boiling water taps in the kitchen may cause substantial risks. These problems are further aggravated by the present further integrated taps that are capable of delivering cold, warm and boiling water from a single outlet.

With existing boiling water taps it is attempted to reduce these risks by making the operation action different from normal and "non-dangerous" taps.

A boiling water tap is, e.g. described in EP 0 792 970. This tap is provided with "child-proof" operation, wherein for operation a push-rotate movement must be executed with the operating knob. Such a compound movement prevents unintentional opening of the tap, but may usually be executed rather easily by an adult to operate the tap intentionally.

It appears that, in practice, the active opening, even by for instance said push-rotate movement, does not always make the user sufficiently aware of the fact that the tap concerned is not a common water tap. Furthermore, the newest boiling water systems have almost no more "cold forerunning", meaning that the (almost) boiling water flows out of the tap almost immediately. As a result of this, a user who puts his hands under the tap, no longer has sufficient time to react to the very high temperature of the water already flowing out.

A boiling water tap is known that is operated by pushing a push button at an operating panel one or more times, whereupon the boiling water flows out and a lamp on the control panel is illuminated.

The operation of a push button is, for many persons, a deviation from the known manner of operating a tap to such a degree that the use of the system is hardly intuitive and user friendly. For the drawing of boiling water, it is standard required to keep the little button pushed down, in order to let the water flow. By a special setting it is possible—after the button has been pushed down for 10 seconds—to release the button while the water flow remains intact. By pushing the button another time, it is then possible to close the tap. The pushing of the button thus may lead to either opening or closing of the boiling water tap. This operation is so complicated, because a simple and non-intuitive operation is not applied. Furthermore, during the pushing of the little button, only one hand is available for the cup or pan to be filled with boiling water. This is less ergonomic and safe than the tapping of boiling water with two hands available for holding the cup or pan.

Additionally, it is possible for persons, in particular children, to play with the button and to open the tap unintentionally.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

In view of the above, a need exists for a system with improved safety, in particular for (almost) boiling water. Preferably, the improved safety is also ergonomically easy and intuitively in use. Further, it is desired that the proposed safe operation does not affect the design in a negative way.

Therefore, a dispensing arrangement according to the attached claims is provided.

The dispensing arrangement comprises a tap, in particular a kitchen tap such as a boiling water tap, and is provided with an operating element for operating the tap, wherein the dispensing arrangement is operable by means of a compound movement of the operating element. For dispensing water by the tap, at least a portion of the compound movement serves to release the shut-off valve prior to operation and comprises at least one of a movement to-and-fro, a repeated movement and a movement of at least a predetermined duration and wherein a subsequent portion of the compound movement serves to operate the shut-off valve. Thus, at least a portion of the compound movement must be executed to and fro, repeatedly, and/or for at least a predetermined duration. By having to repeat or undo at least a portion of the compound movement, and/or by executing of a portion of the movement for a given duration, for instance interrupting the compound movement at a specific position, the user is made aware of the special nature of the tap. This allows for the timely reconsideration of opening of the tap. For instance, the operating element may have to be moved up-and-down one time or more often before it is possible to rotate it for the eventual dispensing of water, or a handle must be moved to one side first and then to another, possibly opposite side. The actual operation of the tap for dispensing water thus is made possible only after the user has consciously executed an unlocking action.

A compound movement may refer to a series of singular movements, for instance a series of translations and/or rotations in mutually differing directions. In this manner, a series of physical movements is required from the user that makes the user more conscious of his/her actions. Such a series of actions may further improve child safety.

Preferably, the same operating element is used for releasing (the safety action) and operating (opening of the tap). This serves both the operating comfort and the design.

Preferably, the compound movement comprises two different movements, such as a translational movement and a rotational movement, for increased alerting.

An efficient construction of the operating element is simplified, and user comfort is increased, if the compound movement comprises a translational movement and a rotational movement with respect to a single axis, in particular push-rotate and/or pull-rotate movements. A zigzag movement or undulating movement is also anticipated. A push-rotate movement is preferred because it is possible to construct the required operating elements relatively easily and especially because this movement is intuitive and known. A rotating movement is further the best-known manner for operating a tap.

Although it is possible to implement the dispensing arrangement described mechanically, for instance by applying locking techniques of combination locks, rotating locks and such, it is preferable to provide the dispensing arrangement with a sensor and a control unit arranged for detecting at least a portion of the multiple and/or compound movement, preferably at least the portion of the multiple and/or compound movement that is to be executed to and fro and/or repeatedly. Thus it is possible to sample the safety movement electronically and to monitor the dispensing arrangement. As a result, it is for example possible to obtain a compact construction. Such a dispensing arrangement may issue a signal when the (sampled part of the) compound movement is executed in the right or wrong manner, for instance a light- and/or an audio signal to warn the user. The control unit may be programmable. As a result, the functionality may be programmable within the mechanical boundary conditions and/or be modified at a later stage.

In an embodiment, the dispensing arrangement comprises a sensor and a control unit arranged for electronic release of the operation of the dispensing arrangement. As a result, it is possible to still prevent the dispensing of water, at improper use of the operating element in which the element is brought into a use position (and the tap thus would be "opened"), resulting in an increased safety.

The sensors and/or the control elements may be integrated and/or programmable for detecting and/or "recognising" different movements, with as result that it is possible to set and use different series of security movements.

In a preferred embodiment, the dispensing arrangement is provided with an electronically operated shut-off valve, wherein the control unit is arranged to control the shut-off valve. This enables an efficient use of the electronic detection of movement. It also allows for a large freedom in design of the tap, because mechanical aspects may become less relevant. Further, the shut-off valve may be provided at a distance remote from the tap, thus possibly reducing heat losses in piping. This also positively influences the manufacturing and design of the tap.

In an embodiment, the tap comprises a tap housing and the operating element comprises a knob coupled to the tap housing for executing the multiple and/or compound movement with the knob with respect to the tap housing. This comes close to a common tap, which may promote its operating comfort and acceptance.

A slim design is possible if, in such an embodiment, the tap comprises an outlet and the knob is arranged around the outlet in a slidable and/or rotatable manner.

For an increased flexibility and ease of use, the tap may comprise an operating element arranged for operating the tap for the delivery of cold and/or hot water, for example as a mixer tap. This enables the provision of an integrated tap for water of several temperatures.

In a preferred embodiment, the dispensing arrangement is provided with a pressure vessel and arranged for delivering flowing boiling water, at least water at a temperature of over 90 degrees Celsius, from an outlet of the tap. Thus, various types of drinks and foods may be prepared in a simple manner.

Such an embodiment may further be provided with an installation for and be arranged for delivering cold and/or hot streaming water from an outlet of the tap. Thus, the arrangement is capable of delivering water at several temperatures, possibly using one or more shut-off valves that are operated by one or more operating elements. A special embodiment may be arranged for delivering hot running water by mixing cold running water with boiling running water out of the pressure vessel. In this case, no separate hot water supply is necessary to still provide water of various temperatures.

The invention will hereafter be clarified on the basis of the accompanying figures that show an embodiment of the present invention by manner of example in a non-limiting manner.

The figures are schematically and possibly not to scale; details that are not necessary for an understanding of the invention may have been left out. Elements that are substantially equal and/or provide equal functions are provided with the same reference numeral.

DETAILED DESCRIPTION OF THE ILLUSTRATIVE EMBODIMENTS

Figure 1:
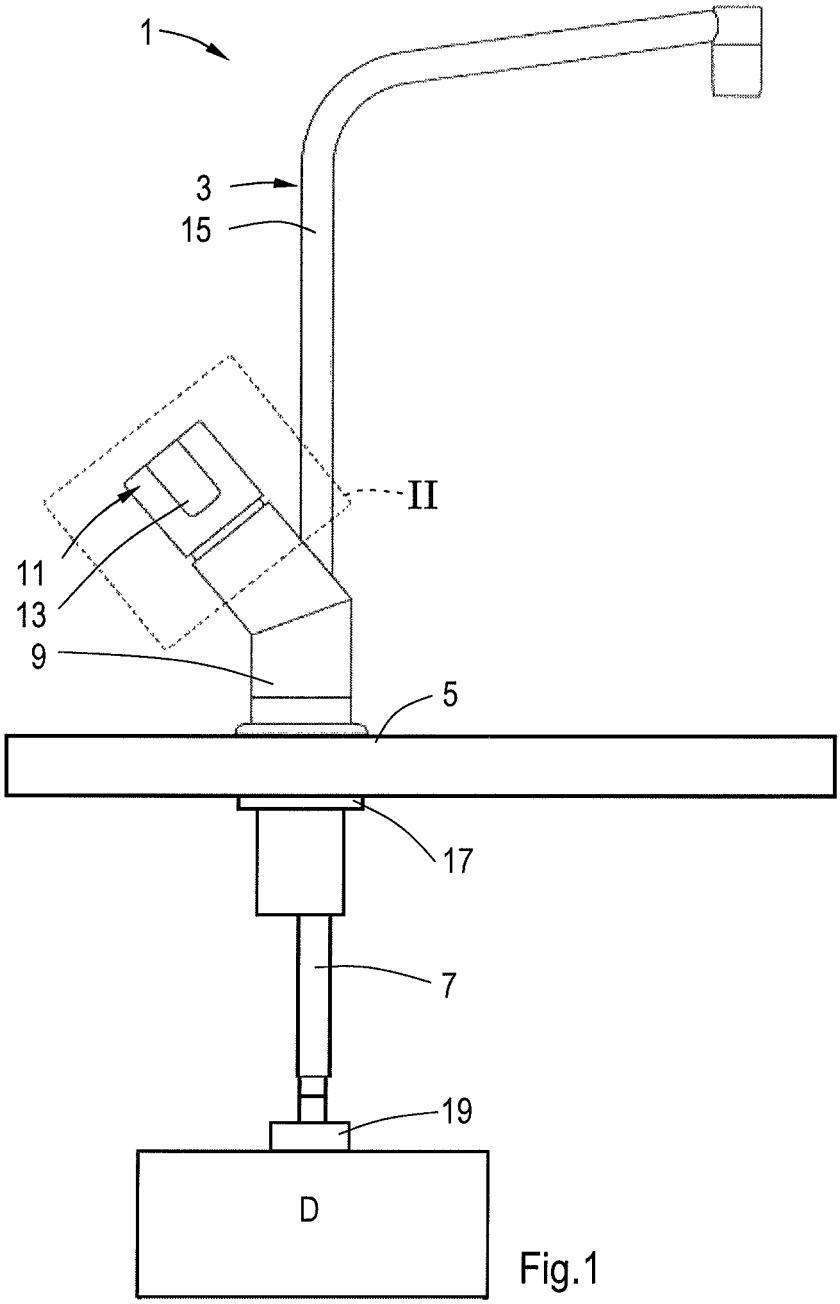
FIG. 1 is a side view of a water tap.

In FIG. 1, a dispensing arrangement 1 is shown comprising a tap 3 mounted on a kitchen working top 5. The tap 1 has a supply pipe 7, a tap housing 9, an operating knob 11 with a grip provision 13 and an outlet 15. The grip provision 13 may comprise a recess, a handle or a projection. The supply pipe 3 is suited to be mounted to a water supply, for example via a pressure vessel D for the storage and heating of pressurized water, for example the pressure of the water supply system or higher for increasing the boiling temperature of the water, whereby it is possible to provide running boiling water out of the outlet 15.

The tap 3 and the tap housing 9 are fixed to the kitchen working top 5 by means of a lock up nut 17, but other manners of fixing are possible. The tap 3 can be operated by moving the knob 11 relative to the tap housing 9. Operation of the tap 3 by means of the knob 11 may be mechanically, for example by means of a shut-off valve in the tap housing 9, the shut-off valve being connected to the knob 11. In the shown embodiment, the tap 3 can be controlled electronically, and the shut-off valve 19 is not provided in the tap housing 9 but on the pressure vessel D. This offers an increased freedom for the design of (the tap housing 9 of) the tap 3. Other positions for an electronically operable shut-off valve are also possible.

Figure 2:
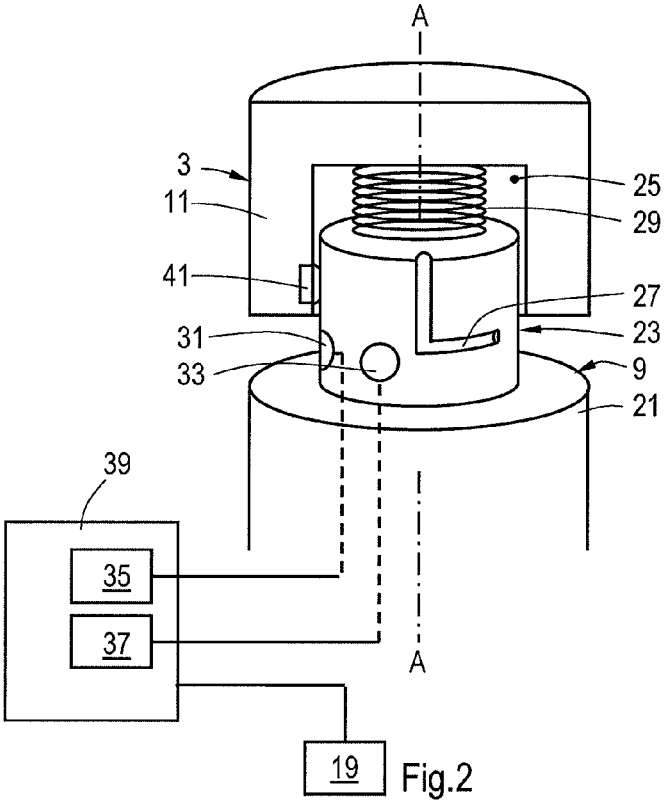
FIG. 2 is a side view of a part of a cross section of detail II in FIG. 1.
Figure 3:
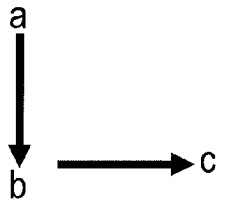
FIG. 3 shows a compound movement for operation of the tap in FIG. 1.

FIG. 2 shows a part of the tap housing 9 and the knob 11 schematically, in cross-section. In this embodiment, the tap housing 9 is provided with a first, relatively wide part 21 and a relatively narrow part 23 accommodated partly as a pivot 23 in a cavity 25 in the knob 11. The tap housing 9 and the knob 11 are provided with cooperating guides defining a specific pattern of movement. Here the cooperating guides are realized with substantially L-shaped grooves 27 in the tap housing, on which internal projections (in the cavity 25, not shown) of the knob 11 engage, such that the knob 11 is rotatable and translatable around the pivot 23 for operating the tap 3 by a push-rotate-movement relative to the axis A. Here the movement pattern a-b-c according to FIG. 3 is followed, for operation.

Other cooperating structures may also be provided for defining a specific movement pattern.

Between the tap housing 9 and the knob 11 a compression spring 29 or another resilient member may be provided in order to drive the knob 11 to a starting position and to offer counter pressure against the pushing movement, thereby increasing child safety.

The tap housing 9 is provided with sensors 31 and 33 connected to corresponding modules 35, 37 of a control unit 39 connected to the shut-off valve 19. The knob 11 is provided with an actuator 41 for the sensors 31, 33. When the tap 3 is operated by a push-rotate movement, the actuator 41 will, as a result of the movement of the knob 11, subsequently pass and activate the sensors 31, 33 (at points b and c in FIG. 3) and corresponding signals in the control unit 39 are activated. The control unit 39 is arranged to release the shut-off valve 19 for control at the detection of a predetermined activation signal or a series of activation signals of the sensors 31, 33. In this case, the control unit 39 is also arranged to operate the shut-off valve 19 after release, although a separate, possibly mechanical, operation is possible.

The series of activation signals may comprise the activation of one or more sensors in a specific order and/or with specific time periods of activation and/or between activation of one or more sensors.

Figure 4:
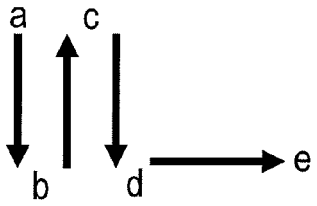
FIG. 4 shows a compound movement for a safer operation of the tap in FIG. 1.

In a preferred embodiment (FIG. 4), for the operation of the tap 3 according to FIGS. 1-2, the knob 11 must first be pressed once, than released without rotation such that the knob 11 bounces back, and thereafter the push-movement must be repeated, before it is possible to execute the rotate-movement that leads to the operation of the tap, with as a result that a series of singular movements push-push-rotate a-b-c-d-e according to FIG. 4 needs to be executed. This activates the first sensor 31 twice (at "b" and "d" in FIG. 4) to release the shut-off valve for operation, whereupon the actual opening of the shut-off valve 19 and dispensing of water from the tap 3 is realized by activation of the second sensor 33. In case the compound movement according to FIG. 3 is executed by a tap that is arranged for operation according to FIG. 4, the first sensor 31 will only be activated once, instead of twice, and the shut-off valve 19 is not released, the activation of the second sensor 33 does not cause the operation of the shut-off valve 19: the tap 3 then does not provide water. The unintended execution of a push-rotate movement with the tap knob 11 therefore does not yield hot water flowing out as a result. By a tap operation according to FIG. 4, the user must consciously repeat a portion of the operation, viz. pushing the knob.

Figure 5A:
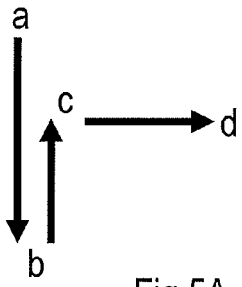
FIGS. 5A-5D show alternative compound movements for a safer operation of the tap.
Figure 5B:
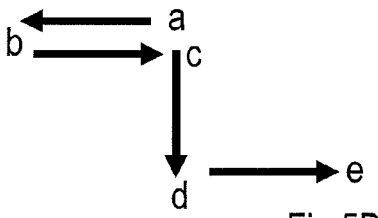
Figure 5C:
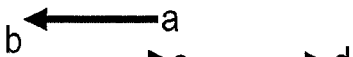
Figure 5D:
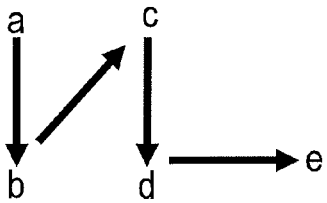

Examples of other series of operation movements of correspondingly arranged operating elements are shown in FIGS. 5A-5D. FIG. 5A for example shows the compound movement push (a-b), partial release (b-c), and rotate (c-d), where in position b or positions b and c a sensor may be activated for the release of the shut-off valve and in position d the shut-off valve is opened. FIG. 5B shows a more complex movement: rotate forth (a-b), rotate back (b-c), push (c-d), rotate further (d-e), for example with activation of a sensor for the release in positions b or d. FIG. 5C shows a simpler, and thereby more user friendly movement: rotate (a-b), rotate back (b-c), rotate further back (c-d). FIG. 5D shows a variant of FIG. 4 in which the single movement between positions b and c combines a rotation and a translation. The movement pattern of FIG. 5C, which may be realized by one or more heart-shaped grooves, by the way also prevents the rotating open of the tap also physically, because the (intuitive) opening movement of the tap (in the drawing from left to right) cannot be reached by only one movement.

A pushing or lifting movement is also possible. In principle the described movements may also be performed by only using translations, rotations or singular movements that combine rotation and translation of the operating element with predetermined directions and end points.

It is also possible to incorporate the factor time for security, for example by requiring in the movement of FIG. 3 and/or 4 the activation of the first sensor 31 during three of five seconds for the release of the shut-off valve, by interrupting the compound push-rotate movement on position b and/or d and holding the knob 11 in that position for the concerned duration. Other time periods may be selected as well.

For an instance of a tap 3, it is possible to program different compound movements.

Figure 6:
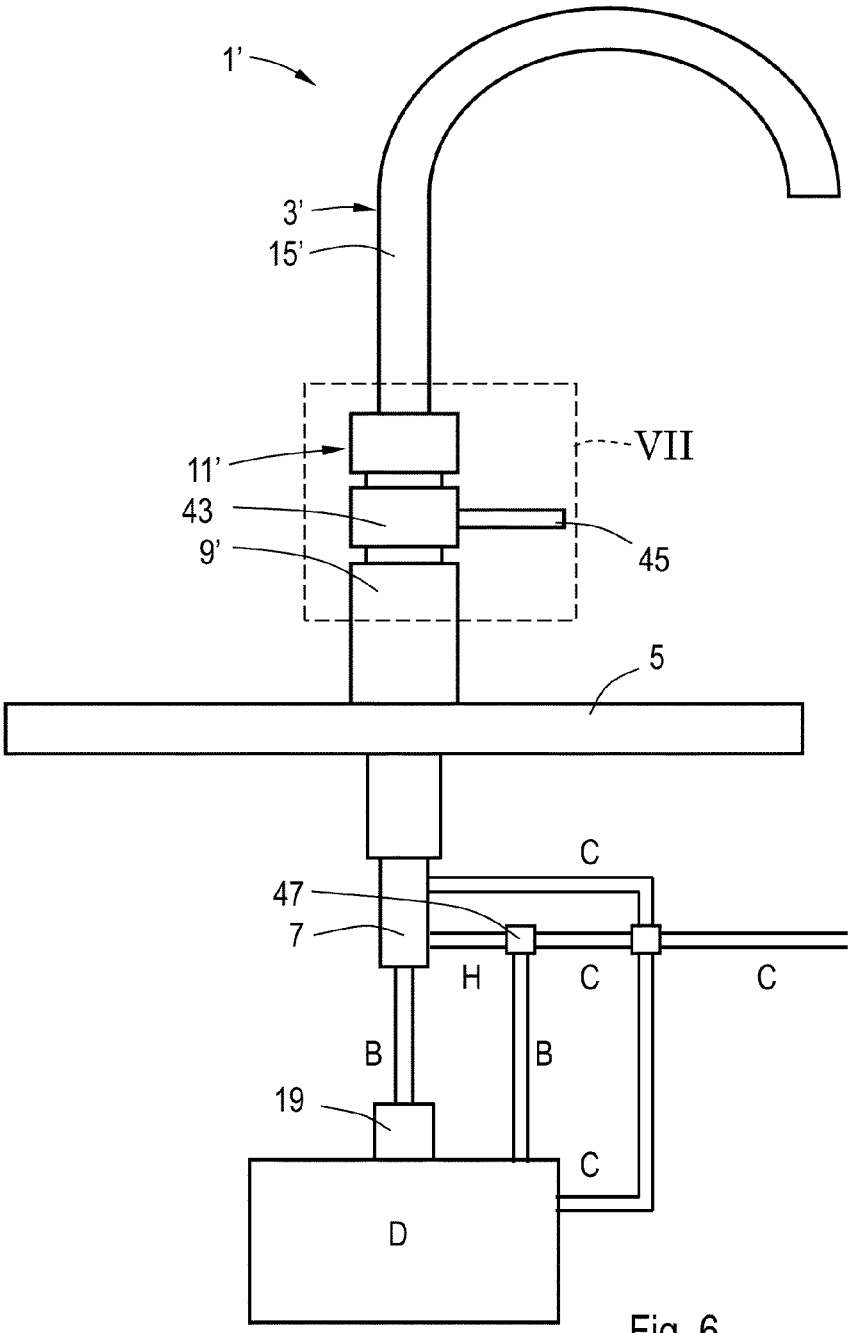
FIG. 6 is a side view of a further embodiment of a tap.
Figure 7:
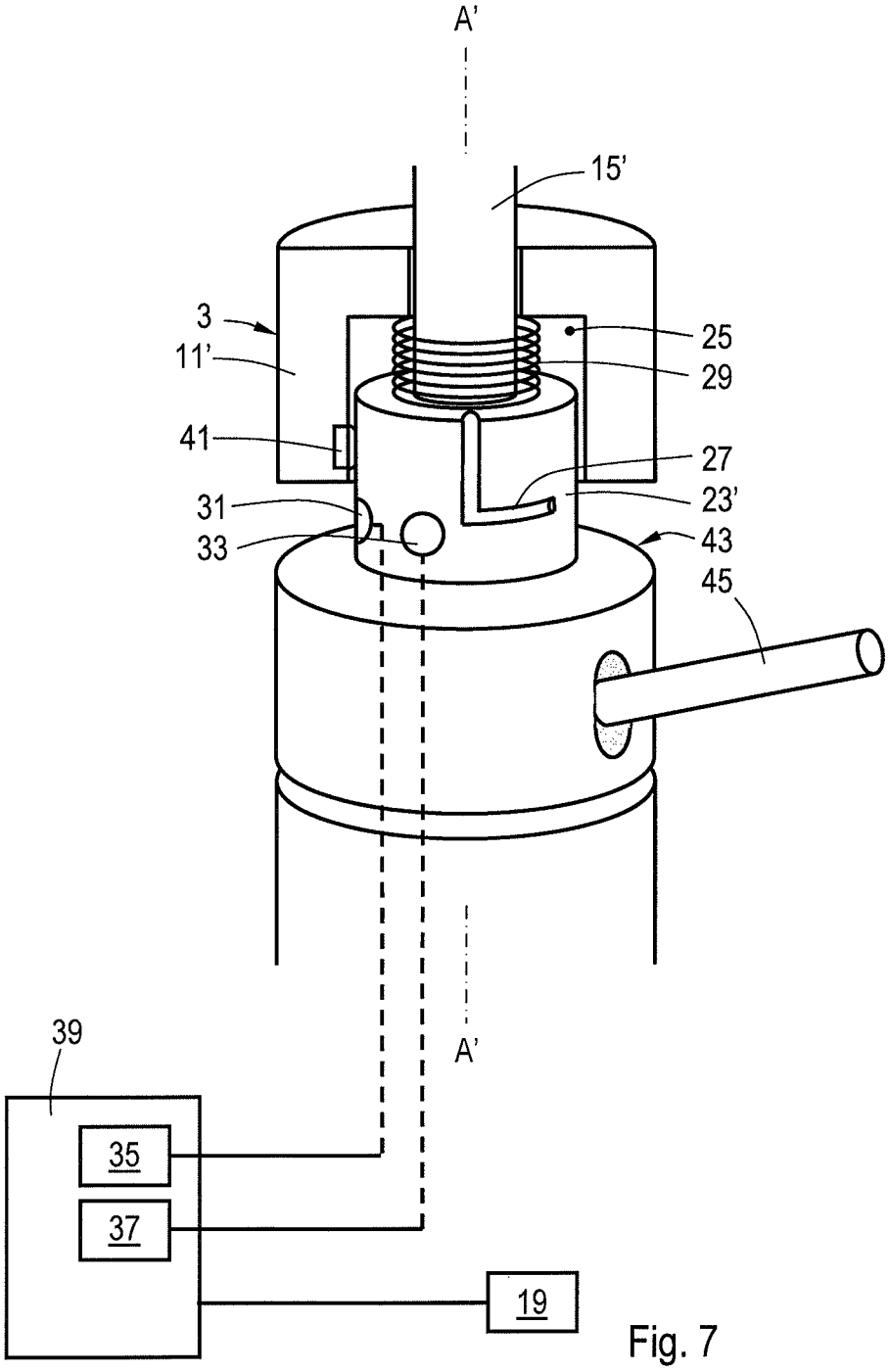
FIG. 7 is a view of a partial cross-section of detail VII in FIG. 6.

FIG. 6 shows as a different embodiment a dispensing arrangement 1' and FIG. 7 shows detail VII of FIG. 6. In this dispensing arrangement 1', the tap housing 9' and the knob 11' are arranged concentrically around the outlet 15', which outlet also defines an axis A' of translation and rotation. Further, the tap 3' accommodates a (possibly not secured) mixer tap module 43 known per se with an operating handle 45. Otherwise the operation and security measures are as described above.

The tap 3' is provided with connections for hot and cold running water. By operation of the mixer tap module 43, it is possible to dispense water of a desired temperature, for instance between 15 and 60 degrees Celsius, from the outlet 15'. Thus only one tap 3' and one tap hole in the kitchen working top 5 are required, to provide cold, warm and (boiling) hot water.

The warm water may be obtained from a warm water pipe and/or from a boiler unit. The embodiment shown is adapted for providing warm running water in pipe H by mixing in mixing unit 47 of cold water system water from water system C with very hot or boiling water via pipe B from the pressure vessel D, which in turn is fed from the (cold water) supply system C. Thus the pressure vessel D is used for two purposes and only one connection is required to (cold) water system water for providing cold, warm and boiling water from a single tap 3'. For setting the temperature of the hot water in pipe H, the mixing unit 47 may be controllable (not shown), for example via the control unit 39. The temperature of the hot water that is actually dispensed by the tap 3', may be set by mixing warm water (H) and cold water (C) in (mixing tap module 43 of) the tap 3 and/or by operation of the mixing unit 47.

The invention is not limited to the embodiments described above, on which variants are possible. The design of the tap may be different. Instead of a knob or ring, the operating element may comprise a handle.

The sensors 31, 33 may be of the same or a different kind, for example optical sensors, wherein the actuator 41 causes a change in reflection, pressure sensors and/or contact sensors that are activated and/or short-circuited by the operating organ. Preferably the sensors and the actuator are arranged for physical, contactless operation, which helps to prevent wear. In a preferred embodiment, the sensors 31, 33 comprise magnetically operable switches, such as so-called reed contacts, and the actuator 41 comprises a magnet.

Elements and aspects of different embodiments may be combined to form other embodiments within the scope of the claims, unless explicitly stated otherwise.

The invention claimed is:

1. A dispensing arrangement for water comprising a tap, provided with a shut-off valve and an operating element, such that the dispensing arrangement is operable with a compound movement of the operating element, wherein the dispensing arrangement is configured to release the shut-off valve without opening prior to dispensing of the water, in response to at least a first portion of the compound movement, wherein the first portion of the compound movement comprises at least one of a movement to and fro, a repeated movement and a movement of at least a predetermined duration, and wherein the shut-off valve is further configured to open after being released only in response to a second subsequent portion of the compound movement.

2. The dispensing arrangement according to claim 1, wherein the compound movement comprises a translation movement and a rotation movement.

3. The dispensing arrangement according to claim 1, wherein the compound movement comprises a translation movement and a rotation movement with respect to a single axis.

4. The dispensing arrangement of claim 3 wherein the compound movement comprises at least one of a push-rotate-movement and a pull-rotate-movement.

5. The dispensing arrangement according to claim 1, comprising a sensor and a control unit configured to receive an output signal from the sensor and to detect at least part of the compound movement, at least the portion of the compound movement that must be executed to-and-fro and/or repeated.

6. The dispensing arrangement according to claim 5, provided with an electronically operable shut-off valve, wherein the control unit is configured to operate the shut-off valve.

7. The dispensing arrangement according to claim 1, comprising a sensor of a programmable, control unit configured with electronic release of operation of the dispensing arrangement.

8. The dispensing arrangement according to claim 1, wherein the tap comprises a tap housing and the operating element comprises a knob that is coupled with the tap housing for execution of the compound movement with respect to the tap housing.

9. The dispensing arrangement according to claim 8, wherein the tap comprises an outlet and wherein the knob is arranged slidably and/or rotatably around the outlet.

10. The dispensing arrangement according to claim 1, wherein the tap comprises an operating element that is configured to operate the tap for dispensing cold and/or warm water.

11. The dispensing arrangement according to claim 1, provided with a pressure vessel and configured to provide boiling running water, at least water with a temperature above 90 degrees Celsius, from an outlet of the tap.

12. The dispensing arrangement according to claim 11, configured to provide at least one of cold and warm running water from an outlet of the tap.

13. The dispensing arrangement according to claim 12, configured to provide warm running water by mixing of cold running water with hot running water from the pressure vessel.

14. The dispensing arrangement according to claim 1, wherein the compound movement comprises a translation movement and a rotation movement with respect to a single axis including at least one of a push-rotate-movement and a pull-rotate-movement.

15. The dispensing arrangement according to claim 1, comprising a sensor connected to a programmable control unit configured to detect at least part of the compound movement.

16. The dispensing arrangement according to claim 1, comprising a sensor connected to a control unit configured to detect at least the first portion of the compound movement that must be executed to-and-fro and/or repeated.

17. The dispensing arrangement according to claim 16, wherein the control unit is programmable.

18. A dispensing arrangement for water, comprising:

a tap, provided with a shut-off valve and a user movable operating element operably connected to the shut-off valve such that the shut-off valve is operable with a compound movement of the user movable operating element; and a control unit configured to monitor the compound movement of the user movable operating element, and in response to at least a first portion of the compound movement comprising at least two specific movements of the user movable operating element, releasing the shut-off valve without dispensing water prior to opening of the shut-off valve, and in response to a second subsequent portion of the compound movement, opening the shut-off valve to dispense water, wherein opening of the shut-off valve is prohibited by the control unit upon execution of a compound movement lacking the first portion.

19. The dispensing arrangement for water of claim 18, and further comprising a sensor configured to sense movement of the user movable operating element and a control unit receiving an output signal from the sensor and controlling operation of the shut-off valve.

20. A dispensing arrangement for water comprising:

a tap provided with a shut-off valve and an operating element, wherein the dispensing arrangement is operable with a compound movement of the operating element, wherein at least a portion of the compound movement serves to release the shut-off valve without dispensing water, and comprises at least one of a movement to and fro, and a repeated movement and a movement of at least a predetermined duration, and wherein a subsequent portion of the compound movement serves to operate the shut-off valve to dispense water;

a sensor; and a control unit, the control unit configured to detect a specific time period of activation and/or a specific time period between activation of the sensor in at least part of the compound movement, and, for dispensing of the water, at least a portion of the compound movement serves to release the shut-off valve prior to operation and comprises a movement of at least a predetermined duration comprising activation of the sensor with the specific time period of activation and/or with the specific time period between activations of the sensor, and wherein a subsequent portion of the compound movement serves to operate the shut-off valve.

* * * * *